United States Patent [19]

Jameson

[11] 4,109,688

[45] Aug. 29, 1978

[54] ATTITUDE MAINTAINING MECHANISM FOR A MARINE LOADING ARM

[75] Inventor: Neal E. Jameson, Orange, Calif.

[73] Assignee: FMC Corporation, San Jose, Calif.

[21] Appl. No.: 822,977

[22] Filed: Aug. 8, 1977

[51] Int. Cl.[2] ..... B65B 3/04

[52] U.S. Cl. ..... 141/387; 137/615

[58] Field of Search ..... 141/279, 387, 388, 284; 137/236, 615; 61/46, 46.5

[56] References Cited

U.S. PATENT DOCUMENTS 3,805,834 4/1974 Bily ..... 141/387

*Primary Examiner*—Houston S. Bell

*Attorney, Agent, or Firm*—W. W. Ritt, Jr.; J. F. Verhoeven; C. E. Tripp

[57] ABSTRACT

A loading arm having an inner conduit section, an outer conduit section, and a manually operable arm extension, is disclosed. The entire arm assembly is rotatable about a vertical axis, and a motor is provided to raise and lower the inner conduit section about a horizontal axis. Two parallel rods are connected at one end to a fixed link at said horizontal axis and connected at the opposite end to the outer conduit section to maintain the outer conduit section in a fixed attitude at any position of the inner conduit section.

9 Claims, 7 Drawing Figures

ATTITUDE MAINTAINING MECHANISM FOR A MARINE LOADING ARM

BACKGROUND OF THE INVENTION

The present invention relates to fluid transport equipment, such as a marine loading arm, and, more particularly, to mechanism to maintain the attitude of a portion of the arm.

Marine loading arms usually comprise rigid fluid conducting conduits pivotally connected in end to end relation to form an articulated member for conveying oil or other fluid to or from a vessel. Frequently, one or more sections of the arm is driven by a motor to position the arm in a desired position for loading or unloading a ship.

It is sometims desirable, during loading or unloading, to maintain an outer arm section in a fixed attitude regardless of the position of the inner section of the loading arm.

The attitude maintenance mechanism usually employed in the prior art consists of a cable and sheave construction as shown, for examle, in the U.S. Pat. No. 3,889,728. In this type of construction the sheaves are mounted, respectively, at the inner and outer ends of the inner arm, and the outer sheave is generally connected to the member which is to be maintained in a particular attitude. The inner sheave is generally fixed so that when the inner arm is raised or lowered, the outer sheave is rotated by the endless cable and rod assembly connecting the sheaves to maintain the member connected thereto in the desired attitude. Although parallel rods are used in U.S. Pat. No. 3,889,728, they are used only to interconnect sections of the cable. In this type of construction, the outer arm section will remain in the desired attitude so long as the outer sheave does not slip with respect to the cable.

SUMMARY OF THE INVENTION

In the present invention, an improved, more positive, attitude maintaining mechanism is provided which does not depend on the grip between a cable and sheave to hold an outer arm section in a desired attitude. Instead, linear members in the form of rigid rods or taut cables are connected at one end to a rigid support at the inner end of the inner arm, and are connected at the other end to the outer arm to hold the outer arm in a fixed attitude in any position of the inner arm.

It is therefore one object of the present invention to provide a positive control for maintaining a desired attitude of an outer section of a loading arm.

DESCRIPTION OF THE PREFERRED EMBODIMENT

Figure 1:
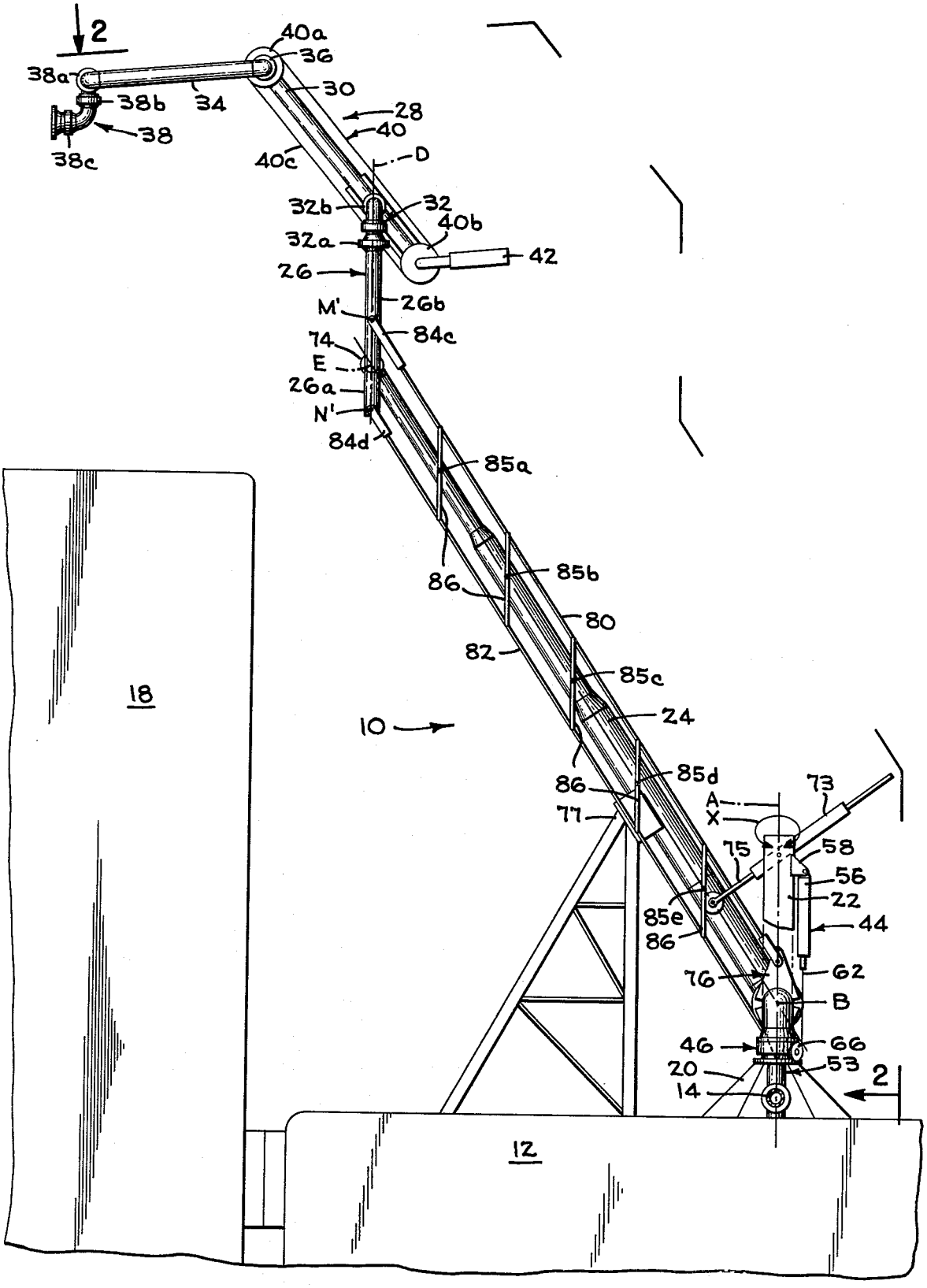
FIG. 1 is a view in elevation of a marine loading arm incorporating the improved attitude maintaining mechanism of the present invention.

The improvement of the present invention is illustrated in conjunction with fluid transfer equipment, indicated at 10, which is mounted on a barge 12. Oil, or other fluid, is transferred by the equipment 10 from the outlet 14 (FIG. 2) of a tank (not shown) on the barge to the inlet 16 (FIG. 4) of a tank (not shown) on a ship 18.

The fluid transfer equipment 10 includes a base 20 secured to the deck of the barge 12, and includes a vertical housing 22 mounted on the base 20 for rotation in either direction, as indicated by arrow X, about vertical axis A. The inner section 24 of a fluid conducting arm is pivotally connected, on a horizontal axis B, for swinging vertical movement relative to housing 22 about axis B, as indicated by arrow Y (FIG. 3), as well as for rotation with housing 22 about vertical axis A. An outer fluid conducting arm section 26 is pivotally connected to the outer end of inner arm section 24 on an axis E, and is maintained, by means to be described, in a vertical attitude, or position, regardless of the attitude of the arm 24.

A manually operated loading arm extension, indicated generally at 28, is pivotally mounted on the outer end of arm section 26. Insofar as the present invention is concerned, the loading arm extension can consist of any fluid transmitting assembly for transferring fluid from the outer end of arm section 26 to the inlet 16 of the tank of ship 18. For illustrative purposes, I have shown the loading arm extension 28 as having an inner arm section 30 pivotally connected by a double swivel joint assembly 32 (comprising swivels **32*a* and 32*b*) to the outer end of arm section 26, and having an outer arm section 34 pivotally connected by a single swivel joint 36 to the outer end of inner extension arm section 30. A coupling assembly 38, comprising swivels 38*a*, 38*b* and 38*c* serves to connect the loading arm extension 28 to the ship tank inlet 16. As shown best in FIG. 1, a sheave and cable assembly 40 (having a sheave 40*a* mounted on arm section 30 and connected to arm section 34, a sheave 40*b* mounted on arm section 30 and connected to a counterweight 42, and an endless cable 40*c* extending between the sheave) serves to counterbalance the weight of the loading arm extension 28**.

The arm sections 24, 26, 30 and 34 consist of rigid, metal, fluid conducting conduits which are pivotally connected together to form an articulated loading arm to transport fluid, such as oil, from the tank outlet 14 on barge 12 to the tank inlet 16 on ship 18.

Figures 2, 3, 4:
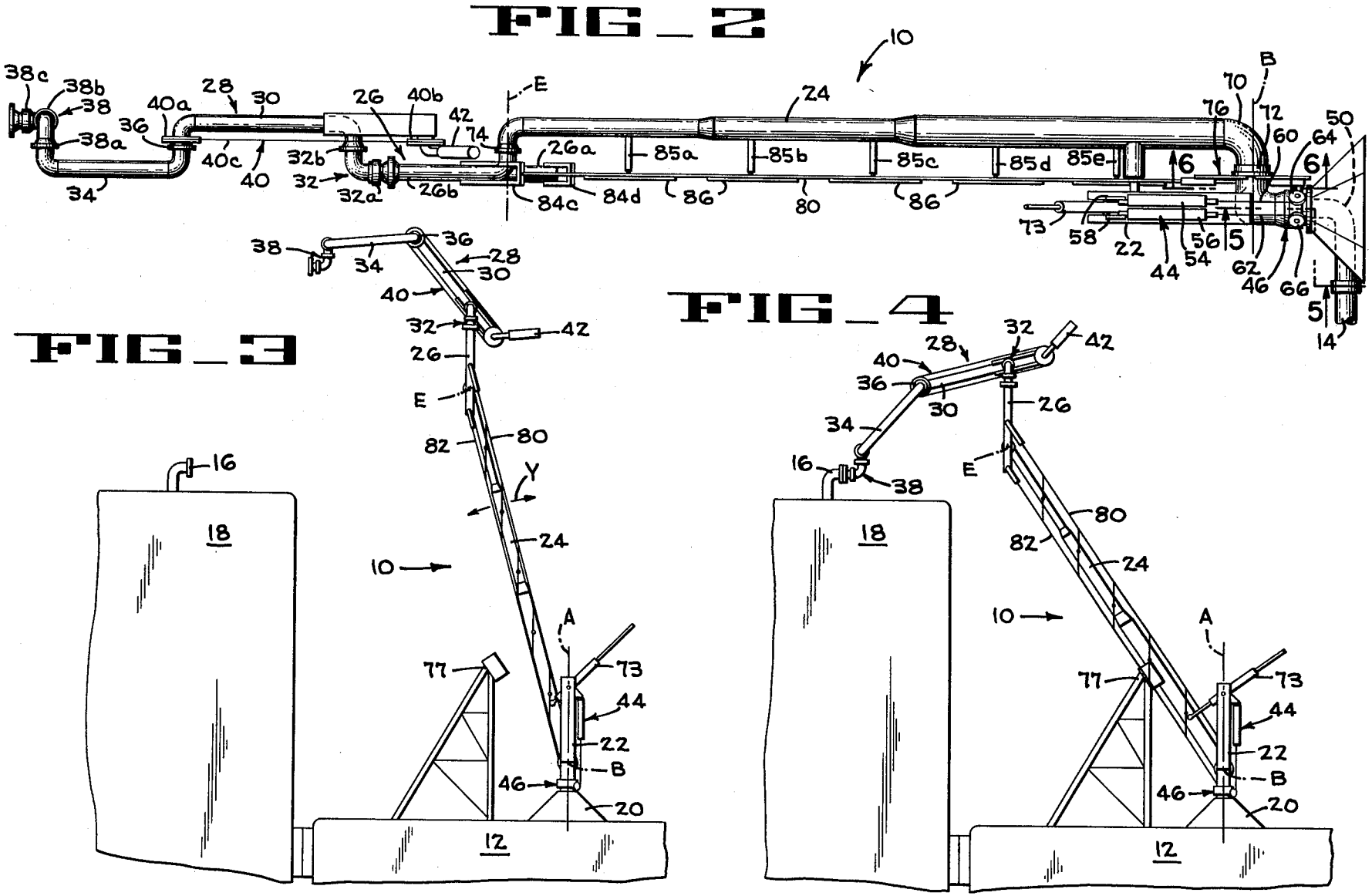
FIG. 2 is a view taken on the line 2—2 of FIG. 1.
FIG. 3 is a view taken as the view of FIG. 1 showing the loading arm in a raised position.
FIG. 4 is a view similar to FIG. 3 but showing the loading arm in a lowered position.
Figure 5:
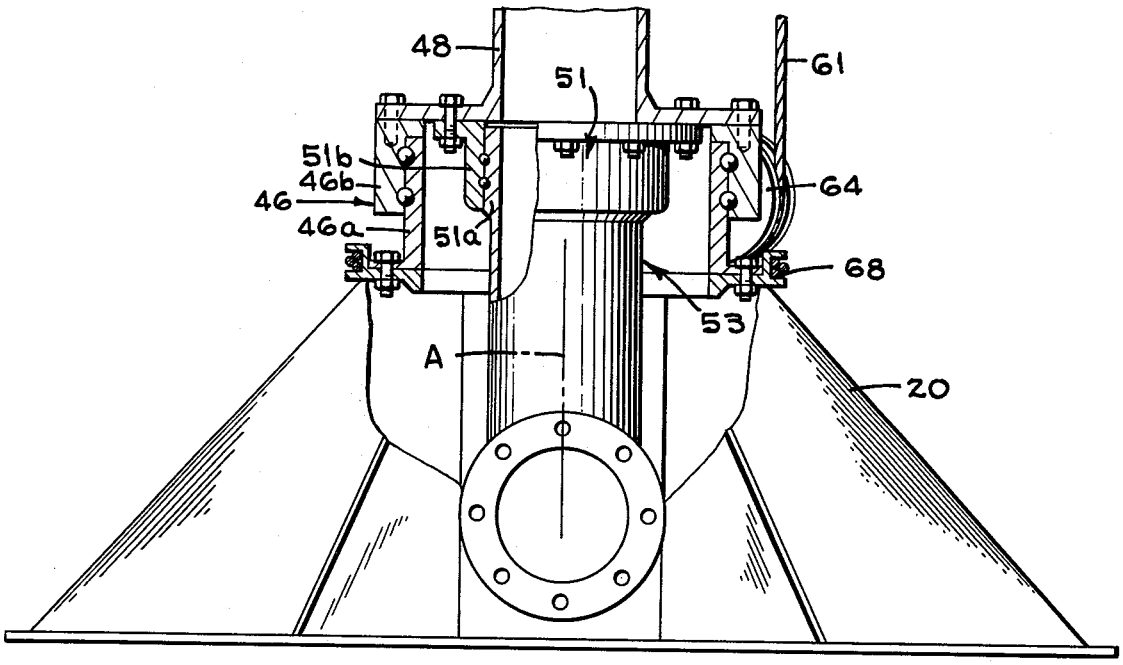
FIG. 5 is an enlarged view taken on the line 5—5 of FIG. 2.

A known type of slew motor 44 (as shown in U.S. Pat. No. 3,409,047) is mounted on housing 22 to effect rotation thereof about axis A. In a manner similar to that shown in the patent, the inner flange **46*a* (FIG. 5) of a swivel 46 is secured to the base 20, and the outer flange 46*b* thereof is connected to the lower flange of an elbow 48. The housing 22, as shown in FIG. 2, is secured over the horizontal portion of elbow 48. An elbow 50, which is mounted in the base 20, has a horizontal section connected to outlet pipe 14. The vertical section of elbow 50 defines the male portion 51*a* of a swivel 51, the female portion 51*b* of which is connected to the lower flange of elbow 48 to provide a fluid passage from outlet 14 through elbow 50 to elbow 48. The stationary elbow 50 and the rotatable elbow 48 define a riser 53 which constitutes a mounting structure to which the inner arm section 24** is pivotally connected.

The slew motor 44 has two side-by-side cylinders 54, 56 (FIG. 2) mounted on a bracket 58 (FIG. 1) secured to the housing 22. Each cylinder has a piston rod extending therefrom which is connected to a cable 60, 62, respectively. Each cable, which is received over a sheave 64, 66, is wound around a groove 68 (FIG. 5) in the housing 20 surrounding swivel 46. The ends of the cables are secured in the groove so that when one piston rod is extended and the other retracted, the housing 22 rotates in one direction about axis A. When said one piston is retracted and said other piston extended, the housing 22 rotates in the opposite direction.

The inner arm section 24 has an elbow 70 which is connected, on horizontal axis B, by swivel 72 to elbow 48. The outer end of arm 24 is connected, on horizontal axis E, by swivel 74 with the inner end of arm 26.

From the description above, it will be seen that the elbow 50, in base 20, is stationary, but is in fluid communication with elbow 48. Elbow 48 is rotatable about axis A and is in fluid communication with elbow 70. Elbow 70 is rotatable with elbow 48 about axis A, and is also rotatable relative to elbow 48 about axis B.

A cylinder 73 is pivotally connected to the upper end of housing 22. The cylinder has a piston rod 75 extending from one end which is pivotally connected to the inner arm 24. When the piston rod is retracted, the arm is raised as shown in FIG. 3, and when the piston rod is extended, the arm is lowered to rest on a support 77 which is mounted on the barge.

The improvement of the present invention is provided to control the attitude of the outer arm 26. The mechanism described hereinafter will hold the outer arm 26 in a predetermined attitude with respect to the horizontal (such as the vertical as shown for illustrative purposes) in any position of the inner arm. The mechanism can also be adjusted to hold the outer arm in a different selected fixed attitude relative to the horizontal regardless of the movement of the inner arm.

Figure 6:
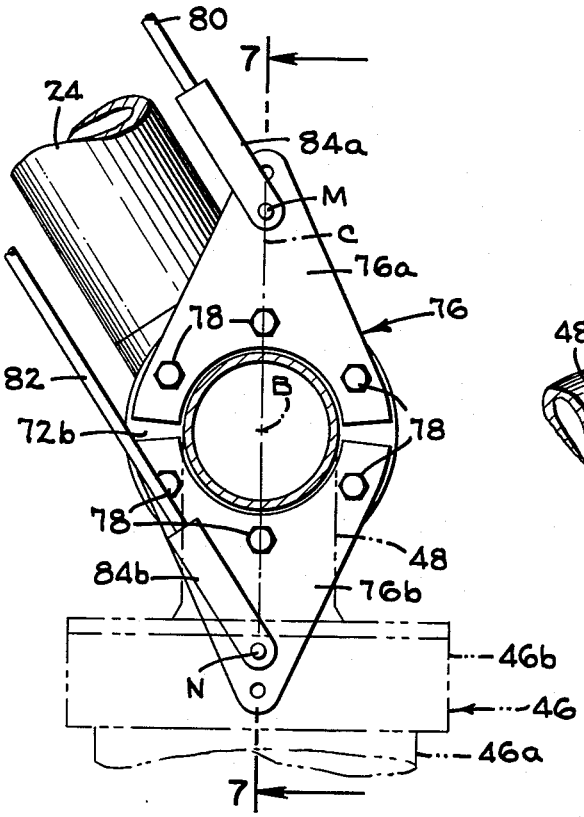
FIG. 6 is a view taken on the line 6—6 of FIG. 2.
Figure 7:
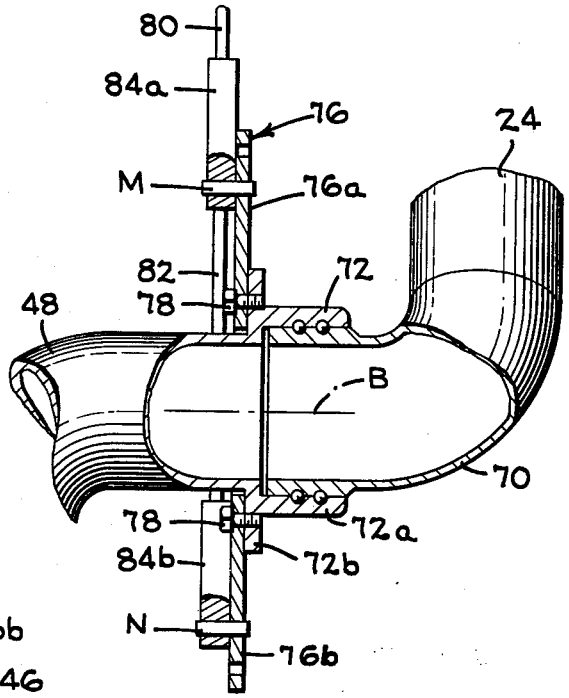
FIG. 7 is a view taken on the line 7—7 of FIG. 6.

As shown best in FIG. 7, the outer end of elbow 48 forms the outer wall **72*a* of swivel 72, through which the elbow 48 is connected to the elbow 70. A flange 72*b* extends out from wall 72*a* and is radial with respect to axis B. A link 76 (FIGS. 6 and 7), made up of two halves consisting of plates 76*a* and 76*b*, is connected by bolts 78 to the flange 72*b*. Two linear members 80, 82 are received, respectively, in tubular fittings 84*a*, 84*b*. The fittings 84*a*, 84*b* are pivotally connected to the link 76 on a vertical axis C which intersects horizontal axis B. The linear members are preferably rigid rods (as shown) for maximum strength and control. The linear members may, however, be taut cables both stretched under tension between fixed link 76 and outer arm 26**.

The member 76, which is secured to riser 53, is referred to as a link because it serves to pivotally receive the inner ends of linear members 80, 82 at points spaced in opposite directions from horizontal axis B. The inner support for the inner ends of linear members 80, 82 could be any member or members fixed with respect to the riser which define pivot points for the connection of rods or cables 80, 82 on an axis C which intersects axis B.

As shown best in FIG. 1, the outer arm 26 has a structural extension **26*a* which does not carry any fluid but which extends in rigid alignment with the fluid conducting portion 26*b* of arm 26. The ends of linear members 80, 82 opposite link 76 are secured in clevis fittings 84*c*, 84*d*, which fittings are pivotally connected to arm portion 26*a* and arm portion 26*b***, respectively.

The inner ends of linear members 80, 82, are pivotally connected to link 76 at points M, N on the vertical axis C which passes through the pivot axis of arm 24 on elbow 48. The points M and N of connection of the rods to the link are equidistant, in opposite directions, from the pivot axis B. The outer ends of linear members 80, 82 are pivotally connected to arm 26 on a central axis D thereof which passes through the pivot axis E of the connection of outer arm 26 to inner arm 24. The points M′ and N′ of connection of the linear members to the arm 26 are equidistant, in opposite directions, from the pivot axis E. Thus, the two linear members 80, 82 are above and below the arm 24, and in parallel relation thereto. to. The linear members 80, 82, the link 76, and the portion of arm 26 adjacent its connection to arm 24, form a parallelogram in any position of the arm 24. Since the inner link 76 is fixed, with axis C in the vertical position, and the rods and arm 26 form a parallelogram with the inner link, the outer arm 26 will always be in a vertical position, regardless of the position of arm 24.

Supporting rods **85*a*, 85*b*, 85*c*, 85*d* and 85*e* (FIG. 2) are secured to arm 24 and extend therefrom. Struts 86 are pivotally connected at their centers to the ends of the supporting rods and are pivotally connected at their ends to the linear members 80, 82**, respectively.

It should be noted that the link 76 (FIG. 6), by removal and replacement of bolts 78, can be angularly positioned so that axis C between the points M, N of pivot connection of the rods will not be parallel to the vertical axis A (the vertical rotational axis of housing 22) but will lie at some angle to that axis. If this is done, the arm 26 will be held at that specific angle to the vertical.

In operation, when transferring fuel from the barge 12 to the ship 18, the loading arm 10 is rotated by slew motor 44 about axis A on barge 12 to point toward the tank inlet 16 on the ship. When the loading arm is in the appropriate angular position, as shown in FIG. 3, the inner section 24 of the arm is lowered by cylinder 73 until the inner arm section rests on the support 77. Thereafter, personnel on the ship 18 can move the coupling assembly 38 to the tank inlet 16 for connection thereto. It will be noted that the inner ends of linear members 80, 82 are connected to link 76 on vertical axis C. As a result, the outer arm section 26 remains in a vertical attitude as the arm 24 is moved from the position of FIG. 3 to the position of FIG. 4.

Although the best mode contemplated for carrying out the present invention has been herein shown and described, it will be apparent that modification and variation may be made without departing from what is regarded to be the subject matter of the invention.

What is claimed is:

1. In fluid transport apparatus having means defining mounting structure, an inner fluid conducting conduit section pivotally connected at its inner end on a first axis to said mounting structure, an outer fluid conducting conduit section, said outer fluid conduit section pivotally connected to the outer end of said inner fluid conducting conduit section on a second axis, the improvement comprising first and second linear control members parallel to said inner fluid conducting conduit section, means pivotally connecting the inner ends of said control members to said mounting structure on opposite sides, respectively, of said first axis, and means pivotally connecting the outer ends of said control members to said outer fluid conducting conduit section on opposite sides, respectively, of said second axis.

2. The apparatus of claim 1 wherein said linear control members are rigid rods.

3. The apparatus of claim 1 wherein said linear control members are taut cables.

4. Fluid transport apparatus comprising a riser, an inner loading arm section, means pivotally connecting the inner end of said inner loading arm section to the riser on a first horizontal axis, an outer loading arm section, means pivotally connecting said outer loading arm section to the outer end of said inner loading arm section on a second horizontal axis, first and second linear control members mounted in parallel relation to said inner loading arm section between said riser and said outer loading arm section, means pivotally connecting the inner ends of said control members to said riser on opposite sides of said first axis, and means pivotally connecting the outer ends of said control members to said outer loading arm section on opposite sides of said second axis.

5. In a marine loading arm having an inner section pivotal at its inner end about a first horizontal axis and having an outer section, said outer section connected to the outer end of the inner section for pivotal movement about a second horizontal axis, the improvement wherein a link is mounted at the inner end of the inner arm section in a fixed attitude with respect to the horizontal, a pair of linear control members pivotally connected at one end to said link above and below, respectively, said first axis, said linear control members extending parallel to said inner arm section for pivotal connection of the other ends of the control members to said outer arm section above and below respectively said second axis.

6. The apparatus of claim 4 wherein said link is mounted in a fixed vertical attitude.

7. The apparatus of claim 5 wherein said linear control members are pivotally connected to said link at points lying on a vertical axis intersecting said first axis.

8. In a marine loading arm having an inner section pivotal about one end on a first horizontal axis, said loading arm having an outer section connected to the outer end of the inner section for pivotal movement about a second horizontal axis, said outer section having portions extending on both sides of said pivotal connection, the combination comprising a member at the inner end of the inner section, a pair of control rods pivotally connected to said member, respectively, above and below said central axis, on an axis intersecting said first axis, said rods extending parallel to said inner section and pivotally connected to said outer arm, respectively, above and below said central axis of the inner arm section, on an axis intersecting said second axis, and at least one strut pivotally connected to both of said control rods and pivotally connected to said inner arm section.

9. In a marine loading arm having an inner section, means to swing said inner action about a first horizontal axis in a vertical plane about its inner end, said loading arm having an outer section connected to the outer end of the inner section for pivotal movement about a second horizontal axis, said outer section having portions extending on each side of said second horizontal axis, the combination comprising a link at the inner end of said inner section, said link fixed at a predetermined angle to the horizontal and having link portions extending on both sides of said first horizontal axis, a pair of control rods of equal length pivotally connected at one end, respectively, to said link portions to straddle said inner arm section, said rods extending parallel to said inner arm section for pivotal connection to said outer arm on opposite sides, respectively, of said second horizontal axis to maintain said outer arm section at said predetermined angle to the horizontal, and a plurality of struts pivotally connected, at opposite ends, to said respective control rods and pivotally connected between said ends to the inner arm section.

* * * * *